United States Patent [19]

Nelson

[11] 4,300,006

[45] Nov. 10, 1981

[54] SYNTHETIC LUBE OIL PRODUCTION

[75] Inventor: William T. Nelson, Bartlesville, Okla.

[73] Assignee: Philips Petroleum Company, Bartlesville, Okla.

[21] Appl. No.: 132,561

[22] Filed: Mar. 21, 1980

[51] Int. Cl.[3] ..... C07C 1/16; C07C 2/74

[52] U.S. Cl. ..... 585/10; 585/16; 585/18; 585/255; 585/329; 585/510; 585/525

[58] Field of Search ..... 585/16, 18, 255, 329, 585/510, 525, 10

[56] References Cited

U.S. PATENT DOCUMENTS

| | | | |
|---|---|---|---|
| 2,412,595 | 12/1946 | Axe | 585/450 |
| 3,330,882 | 7/1967 | Albright | 585/329 |
| 3,382,291 | 5/1968 | Brennan | 585/521 |
| 3,676,520 | 7/1972 | Heckelsberg | 585/647 |
| 3,742,082 | 6/1973 | Brennan | 585/255 |
| 3,763,244 | 10/1973 | Shubkin | 585/18 |
| 3,769,363 | 10/1973 | Brennan | 585/255 |
| 3,780,128 | 12/1973 | Shabkin | 585/12 |
| 3,997,621 | 12/1976 | Brennan | 585/255 |

FOREIGN PATENT DOCUMENTS 1497524 1/1978 United Kingdom .

OTHER PUBLICATIONS

Brennean, "Wide-Temp. Range Synthetic Hydrocarbon Fluids", ACS Washington Meeting, Sep. 9-14, 1979.

Shubkin, "Olefin Oligomers: Structure & Mechanism of Formation" ACS Washington Meetings, Sep. 9-14; 1979.

*Primary Examiner*—Curtis R. Davis

[57] ABSTRACT

A mixed olefin feedstock obtained from disproportionating $C_8$–$C_{10}$ 1-olefins can be used as such, i.e. without removal of 1-olefins in a boron trifluoride catalyzed dimerization step to produce synthetic lubricating oils. The results achieved are as good as those achieved using a feedstock from which the undisproportionated 1-olefins have been removed so that this feedstock contains only internal olefins for the dimerization.

7 Claims, No Drawings

SYNTHETIC LUBE OIL PRODUCTION

This invention relates to the simplified production of an oil from specific hydrocarbons. In another aspect, this invention pertains to avoiding a step in an oil production process heretofore deemed to be necessary.

BACKGROUND OF THE INVENTION

It has been discovered by another inventive entity of which applicant is a co-inventor that 1-olefins can be converted into hydrocarbon oils that are useful in lubrication by a three step process which can be characterized as follows:

Disproportionation of 1-olefin, separation of internal olefin from the unreacted 1-olefin, catalytic dimerization of the internal olefin to the desired hydrocarbon oil.

Whereas this process is believed to constitute a significant contribution to the art of synthetic lube oil manufacture there is a need for further improvement of this process.

STATEMENT OF THE INVENTION

It is an object of this invention to provide a simplified process for producing an oil useful for lubrication from a 1-olefin.

Another object of this invention is to improve the synthetic oil production process described above technically and economically.

A further object of this invention is to provide a process for converting 1-olefins into a hydrocarbon oil which is both highly selective and defined with respect to the compounds produced and at the same time reduces the purification and separation steps to a minimum.

These and other objects, advantages, embodiments, features and details of this invention will become apparent to those skilled in the art from the following detailed description of the invention and the appended claims.

Any U.S. Patent referred to in this specification for further details consistent with this specification is insofar incorporated into this specification by reference.

In accordance with this invention, it has now been found that a feedstock of olefins, said olefins consisting essentially of 1-oefins having the formula $$R''-CH=CH_2 \quad (1)$$

and of internal olefins having the formula $$R-CH=CH-R' \quad (2)$$

wherein R, R′ and R″ which can be the same or different represent alkyl radicals having 6–8 carbon atoms, can be converted into a product from which an oil useful for lubrication can be readily separated. The reaction is done in accordance with this invention by using the mixed olefin feedstock and contacting it with a promoted boron trifluoride catalyst under dimerization conditions.

The mixed olefin feedstock that is utilized in accordance with this invention for the simplest case of only one species of 1-olefins present and under idealized conditions can also be described as a bimodular feedstock comprising a 1-olefin component having a first molecular weight and an internal olefin component having a second molecular weight. The mixed olefin feedstock comprises internal olefin molecules and 1-olefin molecules from which the internal olefin has been produced. The molecular weight of the internal olefin produced equals twice the molecular weight of the 1-olefins, less the molecular weight of ethylene. Or in yet other terms, the number average molecular weight ($M_{ni}$) of the internal olefin portion of the mixed olefins feedstock equals roughly twice the number average molecular weight ($M_{no}$) of the 1-olefin portion of the mixed olefin feedstock minus the molecular weight of ethylene; $M_{ni}=2M_{no}-28$. It has been found that this mixed olefin feedstock resulted in essentially equally good results concerning the properties, yields and selectivities of the oil production process as the same feedstock containing however, no 1-olefins.

Another embodiment of this invention consists in a process for producing an oil useful in lubrication from a 1-olefin. This process comprises contacting a 1-olefin liquid feedstock with a disproportionation catalyst under disproportionation conditions to produce a mixed olefin liquid containing both 1-olefin and internal olefin, and contacting this mixed olefin liquid after removal from the disproportionation catalyst with a promoted boron trifluoride dimerization catalyst under dimerization conditions to form an oil useful in lubrication. The 1-olefin and the internal olefin are characterized by the formulae given above.

This process avoids the step of separating the internal olefin and the unreacted 1-olefin in the previously invented process described above. The feed used in the dimerization step is thus different from the dimerization feed in the process mentioned above. Thus, the unexpected discovery was made that when unconverted alpha olefins are not removed from the product of a metathesis step before introducing this product to a dimerization step that these alpha olefins are at least partially converted to an oil product having a molecular weight in the lubrication oil weight range and the physical properties of the oil are not significantly changed.

METATHESIS STEP

In the disproportionation or metathesis step of the combined process of this invention alpha olefins can be used that have 8 to 10 carbon atoms. Examples for such olefins are octene-1, nonene-1, and decene-1, and mixtures thereof. The normal isomers of these olefins are preferred, although small concentrations of branched isomers can be present. Branched alpha olefins reduce the viscosity index of the oil produced and hence are less desirable components of the starting material.

The initial step of the combined process is the metathesis or disproportionation of alpha olefins to produce a larger internal olefin as follows:

$$CH_2=CHR+CH_2=CHR' \rightarrow C_2H_4+RCH=CHR'$$

where R and R′ are alkyl radicals, preferably n-alkyl radicals, having 6 to 8 carbon atoms. In this reaction it is very desirable to prevent or minimize isomerization of the double bond in the olefin product. Consequently the metathesis reaction is preferably effected at a mild temperature, and with a catalyst useful under mild disproportionation conditions, such as one comprising an oxide of rhenium. U.S. Pat. No. 3,676,520 discloses such a catalyst. The presently preferred disproportionation catalyst is $Re_2O_7$ on alumina.

The temperature for the metathesis reaction can be from about 0°-50° C.; preferably it will be between 20°-30° C.

The pressure for the metathesis reaction can be from about 0.01 to 2 atmospheres absolute ($1\times10^3$ to $2\times10^5$ Pa). For convenience atmospheric pressure is preferred. These relatively low pressures permit continuous or frequent removal of the ethylene produced in the reaction. Without its removal the internal olefin can be cleaved to regenerate the alpha olefins via the reverse metathesis reaction.

Olefin metathesis can be effected continuously or batchwise; for this process the batchwise mode is preferred. Using a catalyst as disclosed in the above identified patent, the weight ratio of alpha olefin to catalyst can range from 1:1 to 100:1. The preferred ratio is about 10:1 to 50:1. It is generally impractical to convert all the alpha olefins because of diminishing reaction rates. However, contact time between catalyst and olefin for batchwise reaction can range between about 1-1000 hours; preferably the contact time is 10-500 hours.

If continuous metathesis is to be effected, catalyst and conditions disclosed in U.S. Pat. Nos. 3,658,927 and 3,586,731 can be used. The former teaches catalysts supported on alumina and the latter teaches catalysts supported on silica. These catalysts are treated with alkaline materials that reduce or destroy catalyst acidity that causes double bond isomerization as described in detail in U.S. Pat. No. 3,586,731. Use of the lower temperatures cited in these patents will help to minimize the undesirable isomerization. The metathesis catalyst is frequently used in a fixed bed reactor.

The metathesis step described above produces an olefin mixture comprising internal olefins as well as unreacted 1-olefins. In addition to the approximate average molecular weight relationship between these two olefins given above, the olefin mixture that constitutes the feedstock for the following dimerization step to be described can be also characterized by the composition. The preferred feedstock will contain about 10 to about 50 weight percent 1-olefins and about 90 to about 50 weight percent of internal olefins. The weight percentages are based on the total olefin content as 100 percent.

DIMERIZATION (OR OLIGOMERIZATION) STEP

Throughout the specification and claims the terms "dimerization", "dimerized", etc., are intended to refer to the chemical combination of two or more molecules to form one new molecule; this term is thus used synonymously with "oligomerization", oligomerized", etc., and not limited to the combination of two molecules.

The product of the metathesis reaction together with the alpha olefins is converted by dimerization to compounds that are useful as lubricating oil basestock. The preferred catalysts that can be used to effect dimerization are promoted boron trifluoride catalysts. The alcohol-promoted boron trifluoride catalysts are preferred. Preparation and use of such catalysts are disclosed in U.S. Pat. No. 3,780,128, Col. 2, line 48 to Col. 5, line 15. The oligomerization of less reactive internal olefins in the invention is carried out at preferably higher temperatures than those disclosed in this patent. Although temperatures in the range—10° to 150° C. can be used for dimerization, the preferred range is about 40°-80° C. The other details concerning the catalyst composition and concentration, method of effecting the reaction, time and pressure of reaction, removal of catalyst, and hydrogenation of the resulting hydrocarbon to produce a synthetic lubricant base stock from U.S. Pat. No. 3,780,128 is applicable to this step of the invention process also, and this patent is herewith incorporated by reference.

The hydrocarbon product of this dimerization step comprises both the oil useful for lubrication and at least small quantities of 1-olefins and internal olefins that have not reacted in the dimerization step, as well as catalyst and some high molecular weight material. The hydrocarbon materials are separated from the catalyst by passing the product stream into a settler in which the stream is separated into a lower and an upper phase. The lower phase contains the boron trifluoride whereas the upper phase is essentially free of this catalyst and contains the hydrocarbons and in particular the dimerized olefins mentioned. The separated boron trifluoride catalyst is preferably recycled to the dimerization step whereas the hydrocarbon product is subjected to further purification to be described.

PURIFICATION AND HYDROGENATION

To obtain the desired physical properties in the synthetic lubricant it is frequently desirable to distill the hydrocarbon mixture remaining after the dimerization step and the removal of the catalyst. The hydrocarbon mixture is subjected to distillation whereby both unreacted 1-olefins as well as unreacted internal olefins are evaporated and can be readily separated from the hydrocarbon product containing the desired oil. For the preferred embodiment of this invention the end point for 1-olefins at atmospheric pressure will be about 175° C., for the internal olefins about 315° C. The unreacted olefins thus separated can be recycled to the dimerization step or to the disproportionation or metathesis step which leaves the internal olefins essentially unchanged, although some loss of olefins occurs. Hence it is preferred to maximize conversion in the dimerization step.

The product with unacceptably high molecular weight can also be removed from the oil. This is generally done by vacuum distillation in which the oil useful as a lubricating basestock is removed as a distillate overhead from a vacuum distillation column. The pressure at which this vacuum distillation is carried out will usually range between 0.01 torr and 100 torr, preferably 1-5 torr. The high molecular weight products are removed from the bottom of the distillation column.

Prior to or after the vacuum distillation the oil produced is generally catalytically hydrogenated. This hydrogenation is done in a conventional procedure such as the one described in U.S. Pat. No. 2,270,303. Typical hydrogenation catalysts that can be used are Ni on alumina, cobalt molybdate on alumina, Pd, Pt, or Ru supported on alumina, or carbon, but not acidic supports. The contacting of the oil produced with hydrogen and the hydrogenation catalyst is preferably carried out after the vacuum distillation for removing the high molecular weight product described above.

Without undue limitation, the following examples describe further preferred details of this invention.

EXAMPLE 1

Four olefin mixtures were prepared that had approximately the composition that would obtain from metathesizing 1-octene and/or 1-decene to thermodynamic equilibrium at conditions at which double bond isomerization is negligible, viz., at ambient temperature. The mixtures were prepared by adding 1-octene and/or 1-decene to distillate fractions. This was done solely as a convenience to obviate making additional metathesis runs, since the distillates were already available. Table I presents the composition of these four mixtures.

TABLE I

| Mixture | I | II | III | IV | V | VI |
|---|---|---|---|---|---|---|
| Feed to metathesis step, mole % | | | | | | |
| 1-Octene | 50 | 50 | 50 | 25 | 25 | 25 |
| 1-Decene | 50 | 50 | 50 | 75 | 75 | 75 |
| Product from metathesis step, wt. % | | | | | | |
| $C_8$ | 20.9 | 0.3 | 0 | 7.0 | 0 | 0 |
| $C_9$ | 1.1 | 0.2 | 0 | 0.3 | 0 | 0 |
| $C_{10}$ | 24.3 | 15.8 | 0.3 | 27.2 | 24.9 | 0 |
| $C_{11}$ | 1.6 | 0.7 | 0.6 | 0.5 | 0.7 | 0 |
| $C_{12}$ | 0.5 | 0.4 | 0.4 | 0.5 | 0.5 | 0.6 |
| $C_{13}$ | 1.9 | 1.4 | 1.7 | 1.3 | 1.4 | 1.9 |
| $C_{14}$ | 9.4 | 15.6 | 18.6 | 3.1 | 3.4 | 4.6 |
| $C_{15}$ | 2.3 | 0.8 | 1.0 | 1.0 | 1.4 | 1.8 |
| $C_{16}$ | 23.2 | 40.6 | 48.5 | 22.1 | 25.5 | 34.2 |
| $C_{17}$ | 1.2 | 0.2 | 0.2 | 0.3 | 0.2 | 0.4 |
| $C_{18}$ | 13.6 | 24.0 | 28.5 | 36.7 | 42.0 | 56.1 |
| $C_{19}+$ | | | 0.2 | | | 0.4 |

Mixture I and IV are simulated products having realistic compositions for a mixture of disproportionated 1-olefins with no removal of the unreacted 1-olefin. Mixtures II and V in Table I do not contain the lighter alpha olefin (1-octene) and resemble products from metathesis from which only the lighter reactant has been removed. Mixtures III and VI are the $C_{11}+$fractions of a disproportionation reaction, i.e., the $C_{10}$ and lighter olefins have all essentially been removed.

EXAMPLE 2

Dimerization (possibly oligomerization) runs were carried out as follows: Table II summarizes the reactants used, the experimental conditions, the yields, and pertinent physical properties of the lubricating oil product.

TABLE II

| Run | VII | VIII | IX** | X | XI | XII** |
|---|---|---|---|---|---|---|
| Olefin mixture (from example I) | I | II | III | IV | V | VI |
| Charge to dimerization reactor, g | | | | | | |
| Olefin mixture | 155 | 66.0 | 78.2 | 84.9 | 106.2 | 78.7 |
| n-Hexane (diluent) | 127 | | | | | |
| n-Heptane (diluent) | | 138 | 136.7 | 135 | 136 | 135.4 |
| n-Propanol | 3.0 | 3.2 | 3.2 | 3.2 | 3.2 | 3.2 |
| Boron trifluoride | 4 | 4 | 3.7 | 4 | 5 | 3.7 |
| Dimerization conditions | | | | | | |
| time, hr. | 6 | 5 | 7 | 5.5 | 6.5 | 8 |
| Temp., °C. | 24–60 | 24–47 | 24–47 | 23–46 | 23–47 | 20–43 |
| Conversion of reactant olefins, wt. % | 80 | 74 | 77 | 73 | 79 | 70 |
| Selectivity to, wt. % | | | | | | |
| Lights (IBP-410° C.) | 15.5 | 5.7 | 5.4 | 3.3 | 5.7 | 2.5 |
| Lube oil (410–510° C.) | 71.5 | 82.3 | 82.3* | 76.8 | 73.1* | 80 |
| Heavies (510° C.) | 13.0 | 12.0 | 12.3 | 19.9 | 21.2 | 17.5 |
| Properties of hydrogenated lube oil | | | | | | |
| Viscosity, SUS at 100° F. | 108.3 | 116.2 | 125 | 113 | 121 | 116.4 |
| Viscosity, SUS at 210° F. | 40.7 | 41.5 | 42.3 | 41.3 | 42.1 | 41.7 |
| Viscosity index | 115 | 120 | 120 | 120 | 125 | 124 |
| Pour point, °C. | <−51 | −46 | −48 | −46 | −40 | −37 |

*410–520° C.
**Comparative runs with olefin removal between the disproportionation and the dimerization step.

Conversion of reactant olefins was essentially the same in these runs where alpha olefins had been removed. This is not unexpected since alpha olefins are known to be reactive under these conditions. However the observation that the properties of the lubricating oil are not changed significantly when compared to those of runs IX and XII respectively is considered to be unexpected. Thus without sacrifice to the process results an "Olefin Separation Step" between the disproportionation and the dimerization step can be avoided.

Reasonable variations and modifications which will become apparent to those skilled in the art can be made from this invention without departing from the spirit and scope thereof.

I claim:

1. A process for producing a hydrocarbon oil comprising (a) contacting a mixed olefin feedstock comprising two olefin components namely a first olefin component of one or more 1-olefins having the formula $$R''CH{=}CH_2 \quad (1)$$

and at least about 50 weight % based on the total olefin content of a second olefin component of one or more internal olefins having the formula $$RCH{=}CHR' \quad (2)$$

wherein R, R′ and R″ which can be the same or different are alkyl radicals of 6–8 carbon atoms, with a boron trifluoride dimerization catalyst under dimerization conditions to form a mixture containing said hydrocarbon oil, and (b) separating said hydrocarbon oil from said mixture.

2. A process in accordance with claim 1 wherein said mixed olefin feedstock comprises the olefin mixture obtained by disproportionating a 1-olefin feedstock having the formula (1) substantially without isomerization.

3. A process in accordance with claim 2 comprising (a) contacting a 1-olefin having the formula (1) with a disproportionation catalyst under disproportionation conditions to form ethylene and said mixed olefin feedstock.

(b) separating said mixed olefin feedstock from said disproportionation catalyst, and (c) contacting said mixed olefin feedstock with a promoted boron trifluoride catalyst as said dimerization catalyst.

4. A process in accordance with claim 3 comprising continuously removing ethylene from a disproportionation zone wherein said disproportionation step is carried out.

5. A process in accordance with claim 1 comprising (a) removing said dimerization catalyst from said mixture to produce a hydrocarbon fluid, (b) subjecting said hydrocarbon fluid to a distillation to remove unreacted 1-olefin and internal olefin from said hydrocarbon fluid leaving a hydrocarbon oil, (c) subjecting said hydrocarbon oil to a vacuum distillation at a temperature above the boiling point of the dimer of said internal olefin under the given pressure of the vacuum distillation to produce an oil vapor and a liquid of high molecular weight components, (d) condensing said oil vapor to produce a purified hydrocarbon oil.

6. A process in accordance with claim 5 wherein said hydrocarbon oil prior to or after said vacuum distillation step (c) is contacted under hydrogenation conditions with molecular hydrogen and a hydrogenation catalyst such as to remove essentially all of the olefinic unsaturation from the oil molecules.

7. Oil produced by the process of claims 1 or 5.

* * * * *